United States Patent [19]

Holmes

[11] Patent Number: 4,464,811

[45] Date of Patent: Aug. 14, 1984

[54] OVER CENTER STRAP BUCKLE

[75] Inventor: Paul M. Holmes, Jackson, Mich.

[73] Assignee: Aeroquip Corporation, Jackson, Mich.

[21] Appl. No.: 418,713

[22] Filed: Sep. 16, 1982

[51] Int. Cl.[3] ..... A44B 21/00; A44B 11/12

[52] U.S. Cl. ..... 24/68 CD; 24/193; 24/196

[58] Field of Search ..... 24/68 R, 68 CD, 68 J, 24/68 SB, 68 E, 69 R, 69 CT, 71 ST, 193, 196, 197, 265 CD, 270; 248/499, 500

[56] References Cited

U.S. PATENT DOCUMENTS

| | | | |
|---|---|---|---|
| 3,145,442 | 8/1964 | Brown | 24/196 |
| 3,256,576 | 6/1966 | Klove, Jr. et al. | 24/196 |
| 3,266,110 | 8/1966 | Davis | 24/193 |
| 3,686,715 | 8/1972 | Brodnicki | 24/68 CD |
| 3,703,024 | 11/1972 | Johnson | 24/68 CD |
| 3,760,464 | 9/1973 | Higuchi | 24/196 |
| 3,866,272 | 2/1975 | Prete, Jr. et al. | 24/68 CD |
| 3,887,966 | 6/1975 | Gley | 24/68 CD |
| 4,118,833 | 10/1978 | Knox et al. | 24/68 CD |

OTHER PUBLICATIONS

Cargo Restraint Hardware Catalog No. 205-Brownline Division-p. 8, Cargo Control Products, Catalog 259-Aeroquip-1982-p. 34.

*Primary Examiner*—Victor N. Sakran

*Attorney, Agent, or Firm*—Beaman & Beaman

[57] ABSTRACT

The invention pertains to an over center strap buckle of the type commonly used in cargo hold-down systems wherein straps connected to the cargo are tensioned to prevent shifting during transport. The buckle includes a handle pivotally mounted upon a U-shaped body, and the tension strap is looped through the handle wherein pivoting thereof between open and closed positions tensions the strap. A manually operated wire latch mounted upon the handle cooperates with notches defined upon the body when the handle is pivoted to the closed strap tensioning position, and the latch includes finger engagable portions for manually displacing the latch from the body notches to release the handle for pivoting to the open tension-release position.

5 Claims, 7 Drawing Figures

OVER CENTER STRAP BUCKLE

BACKGROUND OF THE INVENTION

Cargo hold-down systems for aircraft, trucks, vans, rail cars and the like may include straps interposed between the cargo and the wall or floor of the cargo compartment. Commonly, buckles or winches are utilized with the straps to produce a relatively high tension therein to prevent the cargo from shifting. Such winches and buckles are expensive, relatively troublesome to operate, and the latches utilized therewith are usually relatively expensive and require frequent maintenance and repair.

It is an object of the invention to provide an over center buckle particularly suitable for strap tensioning systems wherein the buckle is of an economical stamped construction, and latch apparatus mounted upon the buckle handle is of a simplified construction for ease of manual operation, economy of manufacture and dependable maintenance-free use over an extended duration.

A further object of the invention is to provide an over center strap buckle incorporating a simplified wire element latch wherein the latch may be economically produced with little specialized equipment, and may be readily assembled to the latch handle.

In the practice of the invention a buckle includes a U-shaped body having parallel outstanding leg portions interconnected by a base. The body includes a pivot pin extending between the legs, and a handle is pivotally mounted upon the pin pivotal between a closed tension producing position and an open tension release position 180° therebetween.

The body sides include an end in which latch notches are defined, and a wire element latch is mounted upon the handle having portions received within the notches when the handle is pivoted to the full tension producing position. The handle includes strap receiving openings through which the tension strap is threaded, and upon the handle being pivoted from the open position to the closed position the strap is pulled about the pivot pin to produce tension, and pivoting of the handle continues until the latch element is received within the body locking notches.

Release of the latch element from the body notches is readily accomplished by the fingers simultaneously engaging and squeezing portions of the latch element toward each other which causes the latch element to clear the locking notches permitting the handle to be pivoted.

As the latch is formed of a wire element, its manufacturing costs are low, and yet, ease of operation, and low maintenance are assured.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
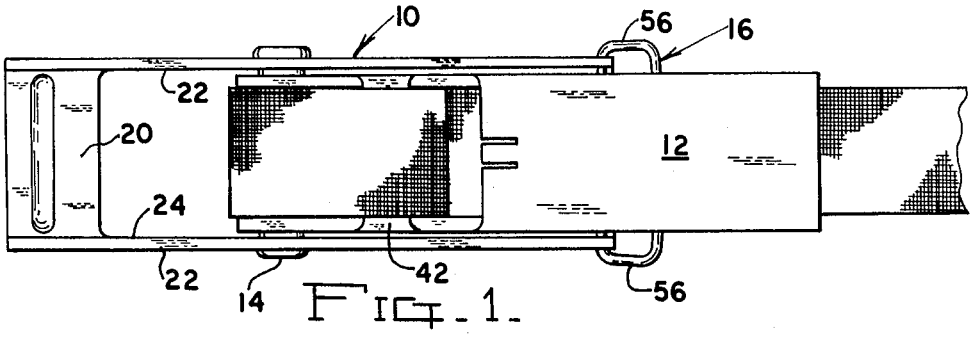
FIG. 1 is a top plan view of a buckle in accord with the invention illustrating the strap associated with the handle, and the handle closed.

The strap buckle in accord with the invention basically consists of a body 10, a handle 12 pivotally mounted upon the body by a pivot 14, and a latch 16 mounted upon the handle. The web or strap 18 to be tensioned is looped about a rib defined on the handle radially spaced from the pivot wherein pivoting of the handle from an open or tension release position to a closed or tensioning position pulls the strap about the pivot tending to shorten the strap and produce a tension therein.

Figure 3:
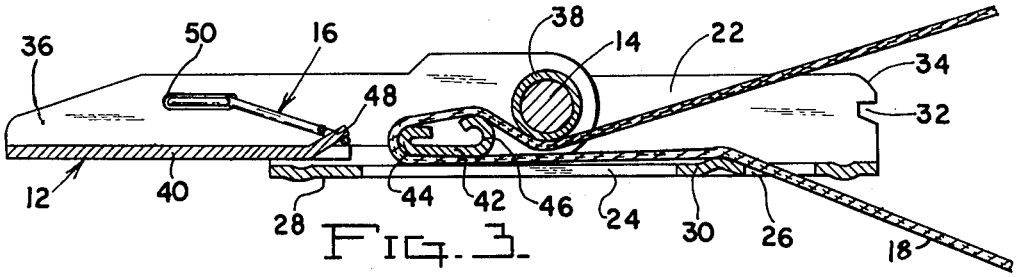
FIG. 3 is an elevational sectional view taken through the buckle, and illustrating the handle in the open position.

The body 10 is stamped of sheet metal and includes a base 20 from which depend parallel spaced legs or sides 22. The body base is formed with openings 24 and 26 which define ribs 28 and 30, and the ribs may be deformed from their planar configuration to increase the strength characteristics thereof. The pivot pin 14 extends between the body sides 22, and the right end edges of the sides, FIG. 3, are each notched at 32, and the body end edges are each provided with an oblique camming surface 34.

The handle 12 is also of a U-configuration and formed of stamped metal, and is of a width capable of being received between the body sides 22. The handle sides 36 include openings for receiving the pivot pin 14, and a tubular spacer sleeve 38 surrounds the pivot pin intermediate the handle sides. The handle base 40 is lanced inwardly defining an anchor rib 42 formed with convex portions 44 and 46, as noted in FIG. 3. A tab 48 is inwardly deflected from the handle base adjacent the opening formed in the fabrication of the anchor rib 42 to serve as a latch anchor, as later described.

The handle sides 36 are each provided with an elongated slot 50, and the latch element 16, which is in the form of a resilient wire, such as of spring steel, cooperates with the slots 50 and the anchor tab 48, and is thereby held within its position in the handle 12.

Figure 6:
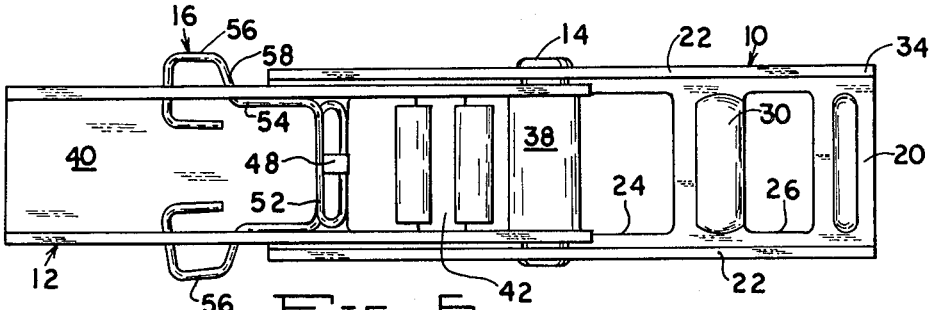
FIG. 6 is a top plan view of the buckle with the handle pivoted to the open position, and tension strap removed.
Figure 7:
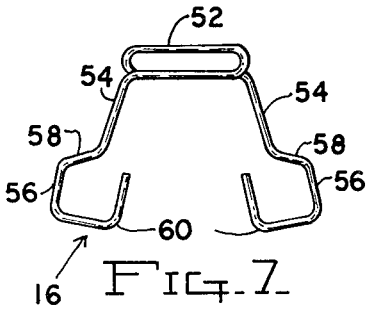
FIG. 7 is an elevational view of the latch element, per se.
Figure 5:
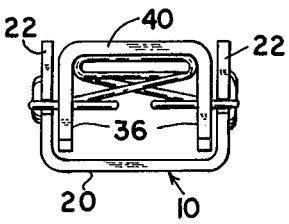
FIG. 5 is an end elevational view of the buckle as taken from the right of FIG. 2, the tension strap being eliminated for purpose of illustration.

The locking or latch element 16 includes an elongated loop 52 in which the anchor tab 48 is received. The element 16 also includes portions 54 disposed along the inner surfaces of the handle side walls 36, and outwardly extending portions 56 pass through the slots 50. The portions 56 each include a section 58 which extends outwardly through the associated slot, and portions 60 extend into the slot and the free ends thereof are bent in the direction of the pivot pin 14. It will be appreciated that the operator may grip the portions 56 with the thumb and index finger and manually deform the wire element from its normal assembled configuration as shown in FIG. 6, to the deformed configuration of of FIG. 4.

In operation, the web or strap 18 to be tensioned is threaded through the body opening 26, around the handle anchor rib 42, and under the pivot 14, as appreciated from FIG. 3. FIG. 3 illustrates the handle in the open untensioned condition, as does FIG. 6.

Figure 2:
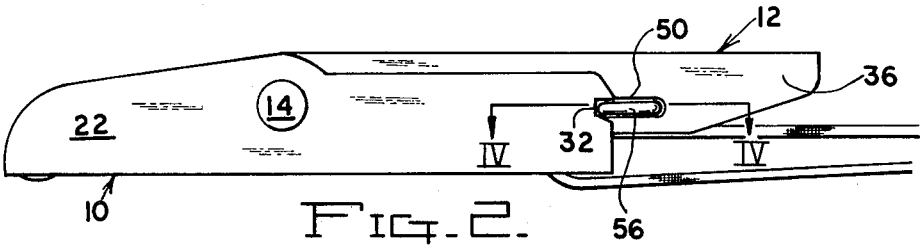
FIG. 2 is a side view of the latch of FIG. 1 as taken from the bottom of FIG. 1.

To tension the strap 18 the handle 12 is pivoted in a clockwise direction from the position of FIG. 3 to the position of FIGS. 1 and 2. As the handle approaches the closed position of FIGS. 1 and 2 the locking element sections 58 engage the body side cam surfaces 34 which inwardly deform the locking portions 56 permitting the sections 58 to ride over the surfaces 34 until the sections 58 are in alignment with the notches 32, and at such time the resilient nature of the latch element 16 causes the sections 58 to enter the notches as shown in FIGS. 1 and 2, and prevent counterclockwise rotation of the handle 12 with respect to the body 10, FIG. 2. In this condition the buckle is in its strap tensioning and operative position.

Figure 4:
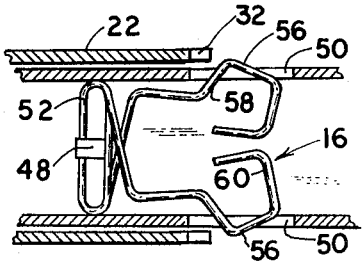
FIG. 4 is an enlarged detail, sectional plan view of the latch element as taken along Section IV—IV of FIG. 2 illustrating the latch deformed to its unlocking position.

To release the buckle and strap tension the operator grips the locking element portions 56 between the thumb and index finger inwardly deforming the same to the position of FIG. 4. Such deformation causes the sections 58 to clear the notches 32 and permit the handle to be pivoted from the position of FIGS. 1 and 2 to the position of FIG. 3, and thereby release the tension in the strap 18.

As the latch element 16 is formed of wire it is inexpensively fabricated, yet is dependable and foolproof in operation. As the portions 56 are well supported within the slots 50, the latch will dependably operate as described, and yet, the support of the portions 56 within the slots permits the wire latch element to adequately resist the shear forces imposed thereon preventing accidental release of the buckle. A strap buckle in accord with the invention will not inadvertently release due to vibration, and the simplicity of the parts permits use by unskilled operators with little or no instruction.

It is to be appreciated that various modifications to the inventive concepts may be apparent to those skilled in the art without departing from the spirit and scope of the invention.

I claim:

1. An over center strap buckle including a body having a U-shaped configuration defining spaced parallel sides having end edges and connected by a base, a handle pivotally mounted upon said body intermediate the body sides pivotal between strap tension and release positions, strap mounting means defined upon the handle, and latch means defined upon the handle selectively cooperating with locking notches defined upon the body side end edges to releasably lock the handle in its strap tension position, the improvement comprising, the latch means comprising solely a resilient element having a pair of opposed finger engaging portions and a handle anchor portion, said finger engaging portions including detent portions normally resiliently biased away from each other in a lateral direction with respect to said body and handle to a locking position adapted to be received within the body locking notches upon the handle being pivoted to the strap tension position and manually displaceable toward each other to an unlocking position clearing the notches to permit the handle to be pivoted to the strap release position.

2. In an over center strap buckle as in claim 1, said handle being of a U-shaped transverse cross section including spaced parallel legs, slots defined within said legs, said finger engaging portions extending through said slots and supported thereby.

3. In an over center strap buckle as in claim 1, said latch means comprising a shaped wire element.

4. In an over center strap buckle as in claim 3, said wire element including a loop defining a base and said finger engaging portions comprising shaped wire free ends extending from said loop.

5. In an over center strap buckle as in claim 4, an anchor projection defined on the handle, said anchor projection being received within said wire element loop.

* * * * *